US009011210B2

(12) United States Patent
Mazza

(10) Patent No.: US 9,011,210 B2
(45) Date of Patent: Apr. 21, 2015

(54) ABRASIVE-SMOOTHING/POLISHING TOOL

(71) Applicant: Franco Mazza, Milan (IT)

(72) Inventor: Franco Mazza, Milan (IT)

( * ) Notice: Subject to any disclaimer, the term of this patent is extended or adjusted under 35 U.S.C. 154(b) by 102 days.

(21) Appl. No.: 13/940,438

(22) Filed: Jul. 12, 2013

(65) Prior Publication Data

US 2014/0017983 A1 Jan. 16, 2014

(30) Foreign Application Priority Data

Jul. 12, 2012 (IT) ..... PR2012A0046

(51) Int. Cl.
*B24B 9/02* (2006.01)
*B24B 33/10* (2006.01)
*B24B 33/08* (2006.01)

(52) U.S. Cl.
CPC ..... *B24B 33/105* (2013.01); *B24B 33/085* (2013.01); *B24B 33/089* (2013.01)

(58) Field of Classification Search
USPC ..... 451/470, 478, 481
See application file for complete search history.

(56) References Cited

U.S. PATENT DOCUMENTS 3,458,961 A 8/1969 Henry
3,710,518 A 1/1973 Grosseau

FOREIGN PATENT DOCUMENTS

CH 235 341 A 11/1944
DE 3223364 A1 12/1983

OTHER PUBLICATIONS

Italian Search Report, dated Apr. 17, 2013, from corresponding Italian application.

*Primary Examiner* — Lee D Wilson
*Assistant Examiner* — Shantese McDonald
(74) *Attorney, Agent, or Firm* — Young & Thompson

(57) ABSTRACT

A smoothing/polishing tool (10) of the type including a hollow cylindrical body (1), a plurality of expansion sectors (4) for a plurality of abrasives (6) integrally mounted on the external surface of an elastic bushing (7), fit on the expansion sectors (4). The tool (10) includes at least one key (11) insertable in one or more cavities (12) or notches obtained along one or more sectors (4); the key (11) bears one or more teeth (11A) adapted to interfere and be engaged with corresponding one or more holes or slits (13) obtained on the bushing (7); following the rotation of the smoothing/polishing tool (10), the key (11) drives the bushing (7) in rotation and at the same time supports the radial motion of the bushing during expansion.

5 Claims, 4 Drawing Sheets

ABRASIVE-SMOOTHING/POLISHING TOOL

FIELD OF APPLICATION OF THE INVENTION

The present finding is inserted in the field of smoothing/polishing tools, and more particularly those loaded by expansion strips and employed in the case in which it is required to obtain size and shape precision and maximum surface finish. They can be mounted on vertical honing machines and not only. The tools are employed for high material removal performances and for a perfect surface finish, as well as for obtaining through and blind holes.

STATE OF THE ART

Currently, said smoothing/polishing tools are loaded by a series of independent expansion strips, each inserted in a corresponding slit of a cylindrical, hollow shank. The smoothing/polishing strips bear on the external surface abrasive sectors made of material such as aluminum oxide, silicon carbide, CBN diamond, with different grain sizes and stone configurations, which remove the material by centering the body of the tool in the hole.

The smoothing/polishing tool is adapted to be inserted in a mandrel which impresses the necessary axial rotation thereto while the smoothing/polishing strips are radially adjusted, inside the respective seat and by means of a rod with conical tip axially slidable inside the tool; as a function of the position of the conical portion, the strips are situated more or less spaced from the axis of the tool, coming to modify the work diameter.

The number of strips generally varies according to the diameter to be smoothed/polished; holes of reduced size require tools with two or four smoothing/polishing strips before then increasing up to twelve.

The same applicant has filed a patent application relative to a smoothing/polishing tool.

Specifically, the tool comprises a cylindrical body, arranged for coupling to a means for controlling the axial rotation thereof, a plurality of sectors placed inside a hollow cylindrical shank thereof; the sectors are controllable in radial position by means of a rod or pusher) having at least one conical end portion. The smoothing/polishing tool bears a plurality of abrasive sectors not directly mounted on the strips, but rather on the external surface of an intermediate bushing, in turn fit on the expansion strips.

STATEMENT AND ADVANTAGES OF THE FINDING

Object of the present finding is to provide the art with an improvement of the abovementioned smoothing/polishing tool and more precisely regarding the driving of the expansion sectors, i.e. those which radially enlarge the bushing.

In order to accomplish this, the present finding employs a sector/bushing coupling system by means of suitable key, longitudinally arranged, which has proven to be very strong.

Overall, the finding provides for inserting a key in at least one cavity (notch) obtained longitudinally along at least one of the expansion sectors, in addition the key bears one or more teeth which are radially extended so as to interfere and engage with corresponding holes or slits obtained on the abrasive-carrier bushing.

Following the rotation of the smoothing/polishing tool, the key drives the bushing in rotation and at the same time supports the radial motion of the bushing during expansion.

In addition, since the bushing must be expanded during processing, in order to allow the attainment of the established diameter during processing, in order to allow the attainment of the established diameter, the solution with key allows this expansion, facilitated, as stated, by the underlying wedge-shaped pin.

Another object of the finding is to ensure a facilitated and correct mounting; for such purpose, the present finding provides a shape of the key such to prevent the bushing mounting in incorrect position.

Indeed, the key has only one possibility for positioning on the body since its teeth are asymmetric with respect to the length of the key itself, its housing in the body is provided in proximity to one of the ends of the sector with notch; it follows that if it is inserted in a reverse manner, one portion would be projecting, not allowing for example the mounting of the ring nut.

Said objects and advantages are all attained by the smoothing/polishing tool, object of the present finding, which is characterized for that provided in the below-reported claims.

BRIEF DESCRIPTION OF THE FIGURES

This and other characteristics will be clearer from the following description of several embodiments, illustrated as merely exemplifying and non-limiting in the following set of drawings.

DESCRIPTION OF THE FINDING

With particular reference to the figures, a smoothing/polishing tool is indicated with 10 in its entirety, such tool used if it is required to obtain size and shape precision and maximum surface finish, as well as obtain through and blind holes. It can be mounted on vertical honing machines and not only.

Figure 1:
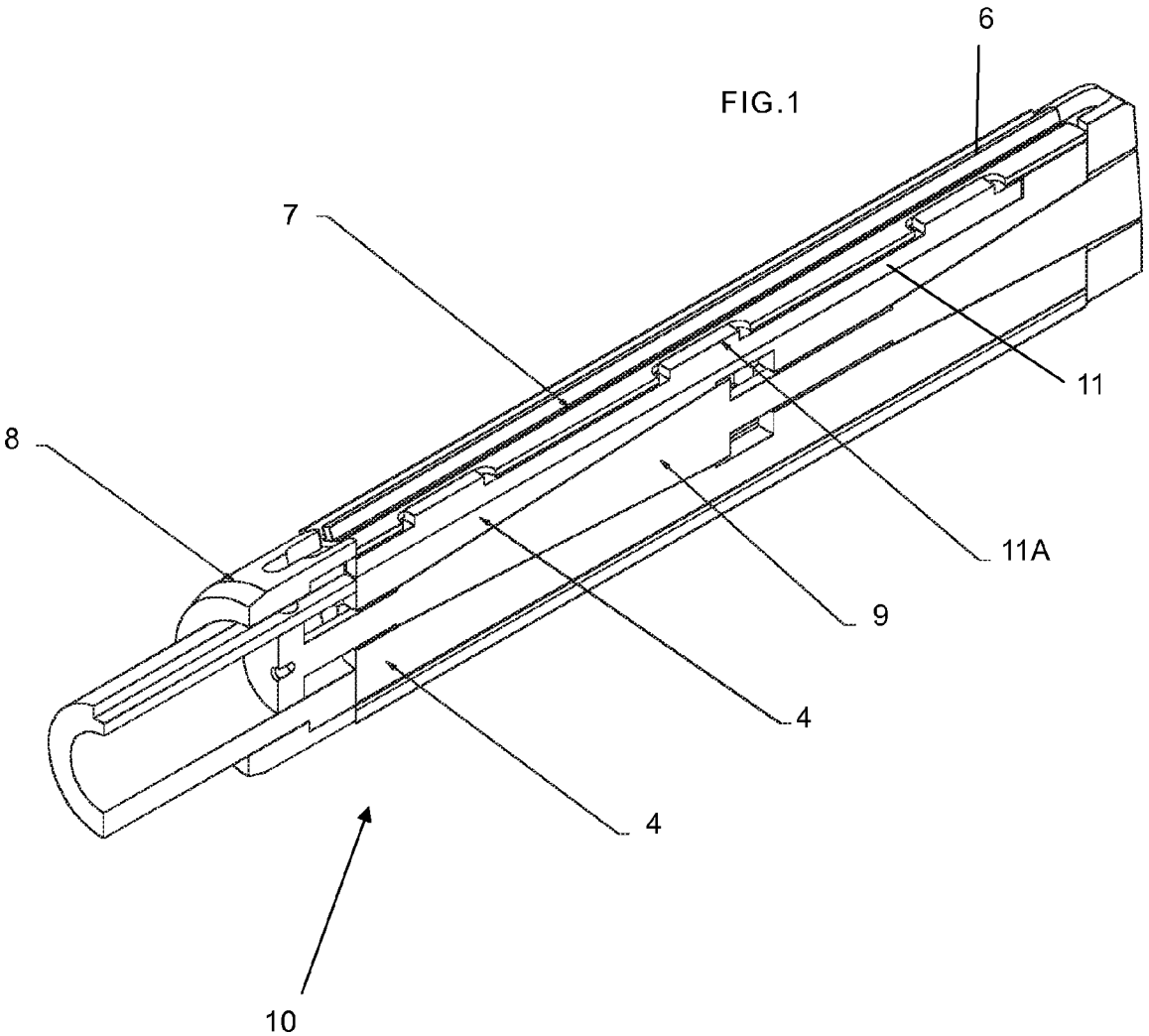
FIG. 1: illustrates the tool for smoothing/polishing according to the object of the finding in a three-dimensional section thereof
Figure 2:
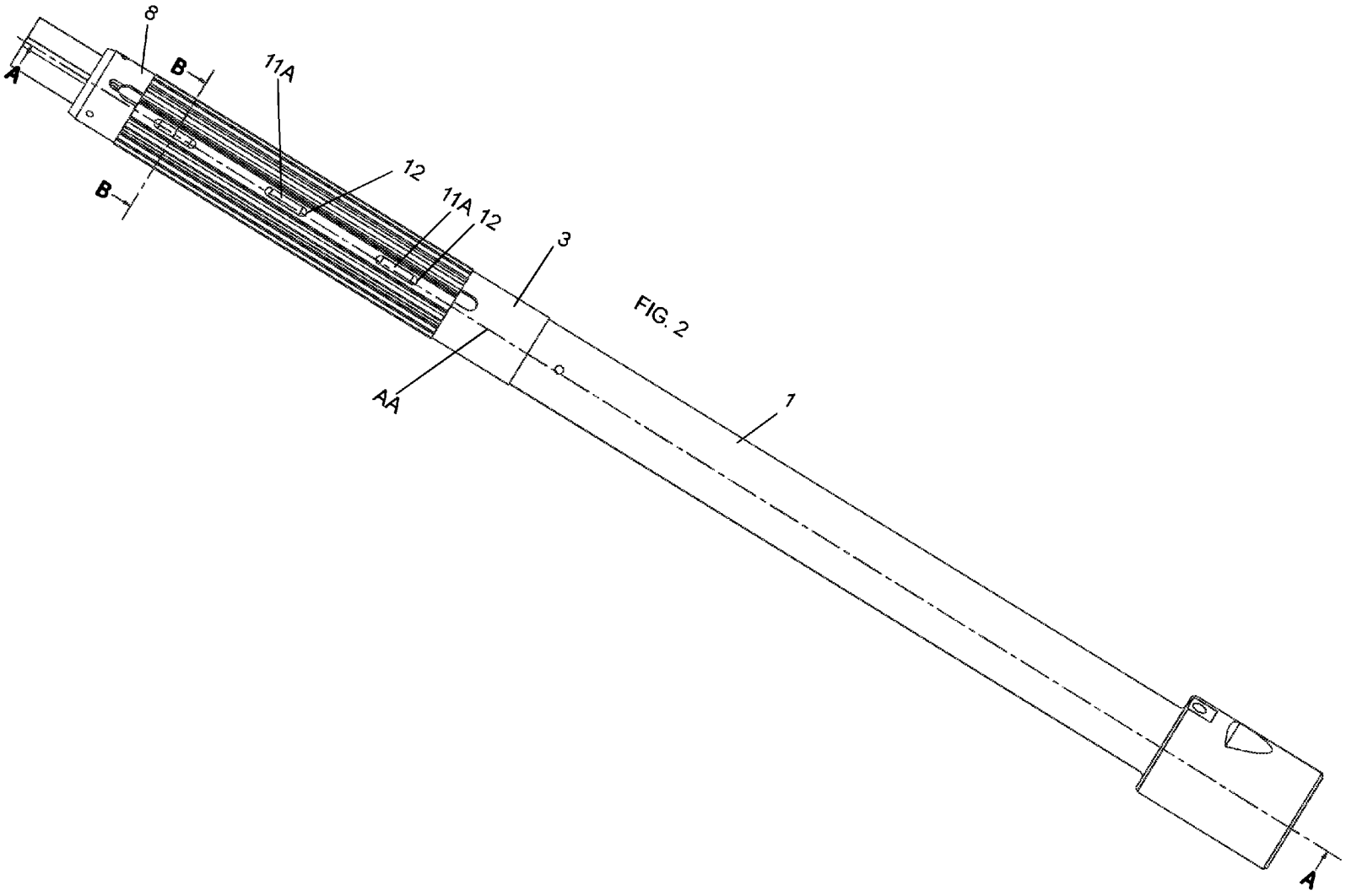
FIG. 2: illustrates the tool in its entirety
Figure 3:
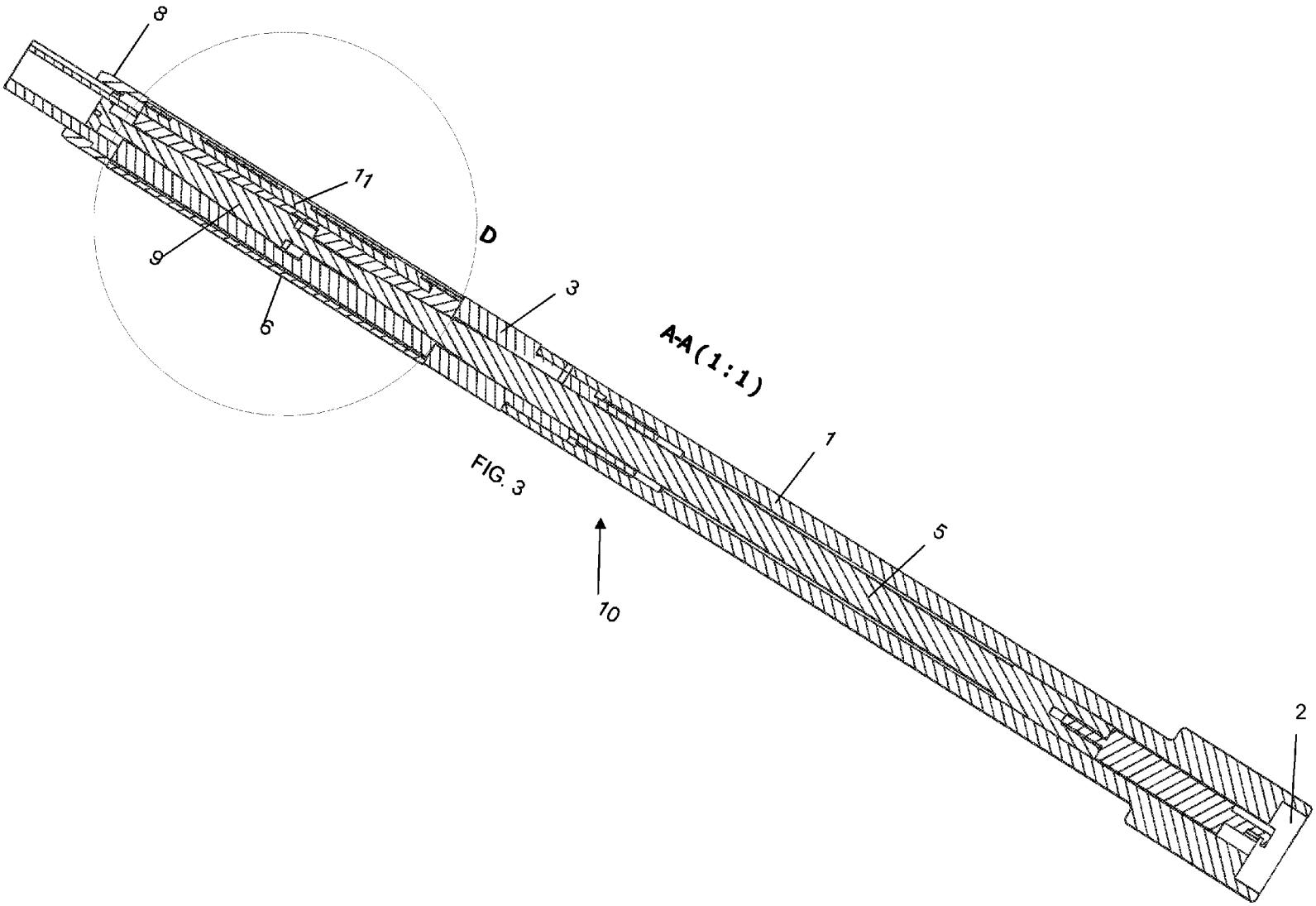
FIG. 3: once again illustrates the tool, along a section A-A thereof
Figure 4:
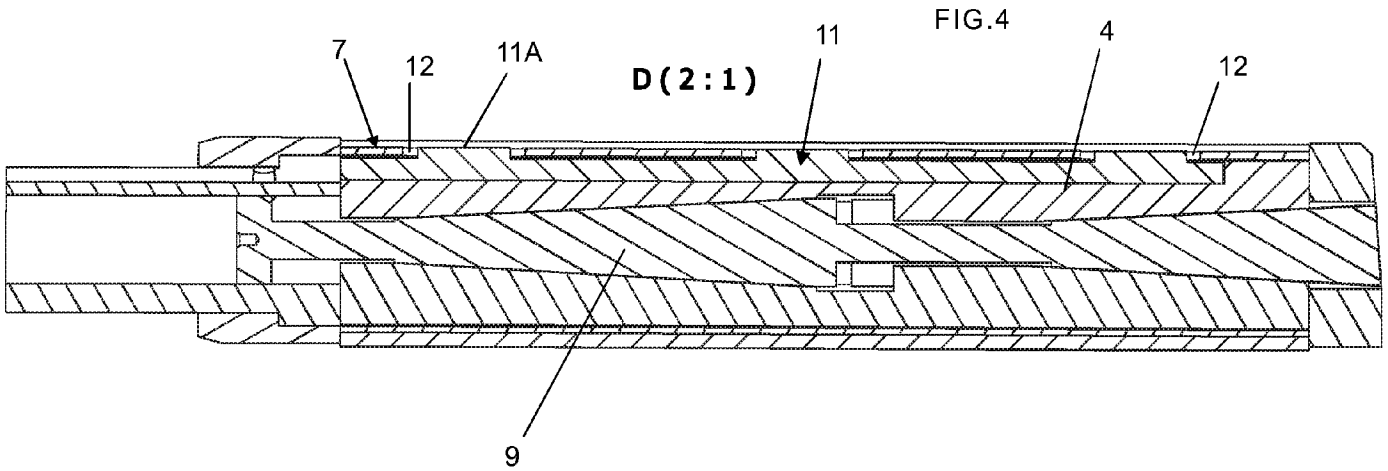
FIG. 4: illustrates the detail D of the FIG. 3

As can be better seen in FIG. 3, which represents the section A-A pursuant to FIG. 2, the tool 10 is constituted by a hollow cylindrical body, indicated with 1, bearing a fitting 2 at the end; said fitting 2 can be coupled to a control means such as a mandrel, such that it can be placed in rotation along the axis AA of the tool.

As is known, reference is made to a smoothing/polishing tool with expansion strips and indeed the presence is noted of a plurality of expansion sectors 4, each of which being housed in a corresponding slit of a cylindrical shank 3.

Shank 3 and body 1 are hollow for allowing the housing and the axial sliding of a rod 5 or pusher adapted to adjust said sectors 4 in radial position; for such purpose, the rod 5 bears at least one conical portion 9, at the zone of the strips.

The presence of a bushing 7 is also observed, i.e. an elastic means on whose external surface a plurality of abrasives 6 are placed.

The abrasives 6 are preferably integral on the external surface thereof.

The bushing 7 has size such that it can be coupled via fitting with the corresponding expansion sectors 4.

The cylindrical bushing 7 is made elastic by means of a longitudinal cutting along the axis AA; this allows an enlargement thereof and the subsequent radial adjustment of the abrasives 6. Naturally, said enlargement is due to the radial action of the sectors 4 thrust by the rod 5 which in the specific case comprises two conical portions 9 in order to allow an easy and distributed thrust action on two points of each sector 4.

Bushing 7 and shank 3 are closed by a front ring nut 8.

Figure 5:
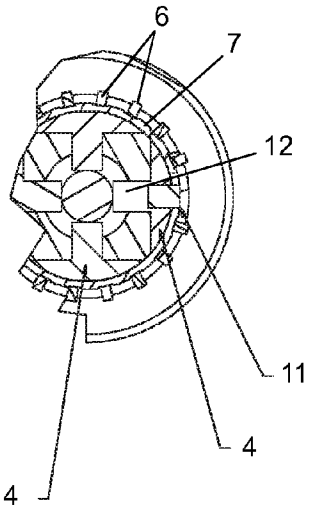
FIG. 5: illustrates the cross section B-B of the tool of FIG. 2.

In the reported embodiment, in particular FIG. 5, the presence of at least one key 11 is observed, inserted in a corresponding cavity 12 or notch obtained longitudinally along one or more sectors 4.

The key 11 in turn, on the side opposite that of abutment in the slot 12, provides for one or more teeth 11A which are radially extended and come to interfere and be engaged with corresponding holes or slits 13 obtained on the bushing 7.

Following the rotation of the smoothing/polishing tool 10, the key 11 drives the bushing 7 in rotation and at the same time supports the radial motion of the bushing during expansion.

Therefore, the key has the object of driving the bushing in rotation, preventing sliding thereof. The coupling on the key has proven much stronger than the classical solutions currently used.

Finally, the shape of the key 11 is such to prevent the bushing mounting 7 in incorrect position. Indeed, the key 7 has only one possibility for positioning since its teeth 11A are asymmetric, in addition to being aligned, with respect to the length of the key itself.

It follows that the insertion of the bushing assembly with key on the mandrel body rotated 180°, hence incorrect position, cannot occur: as it is also provided that the key is housed in a cavity 12 placed next to or in proximity to one end of the sector 4 (ring nut side in the figure), if inserted in a reverse manner, one portion of the bushing would remain projecting, not allowing for example the mounting of the ring nut.

The invention claimed is:

1. Smoothing/polishing tool (10) of the type comprising a. a hollow cylindrical body (1) with fitting (2) for coupling to a means for controlling the axial rotation (AA) thereof, b. a plurality of sectors (4), each of which inserted in a corresponding slit of a cylindrical, hollow shank (3);

said sectors (4) controllable in radial position by means of a rod or pusher (5) having at least one conical end portion (9), c. a plurality of abrasives (6) placed on the external surface of a bushing (7); said bushing (7) in turn fit on the sectors (4);

characterized in that it comprises at least one key (11) insertable in one or more cavities (12) or notches obtained along one or more sectors (4); the key (11) comprising one or more teeth (11A) which in assembled configuration come to interfere and be engaged with corresponding one or more holes or slits (13) obtained on the bushing (7); following the rotation of the smoothing/polishing tool (10), the key (11) drives the bushing (7) in rotation and at the same time supports the radial motion of the bushing during expansion.

2. Tool according to claim 1, characterized in that the teeth are asymmetric with respect to the length of the key; in addition, the housing of the key is in proximity to one of the ends of the sector such that the bushing and key insertion on the body (1) can only occur in one position.

3. Tool according to claim 1, characterized in that said cylindrical bushing (7) is cut along the axial direction (AA) such that it can be enlarged following the radial action of the sectors (4).

4. Tool according to claim 1, characterized in that said rod or pusher (5) comprises two conical portions (9) in order to allow an easy and distributed thrust action on two points of each strip (4).

5. Tool according to claim 1, characterized in that said bushing (7) and shank (3) are closed at the end by a ring nut (8).

* * * * *